US005279086A

United States Patent [19]

Liao

[11] Patent Number: 5,279,086

[45] Date of Patent: Jan. 18, 1994

[54] ALUMINUM FRAME WINDOW WITH VENTILATING MEANS

[76] Inventor: Mao Z. Liao, 1F., No. 16, Lane 70, Alley 12, Sec. 3, Pa Der Rd., Taipei, Taiwan

[21] Appl. No.: 918,463

[22] Filed: Jul. 22, 1992

[51] Int. Cl.[5] ..... E06B 1/20

[52] U.S. Cl. ..... 52/212; 52/217; 52/209; 52/204.56; 52/475; 49/505

[58] Field of Search ..... 52/212, 213, 217, 209, 52/204.56, 475, 455; 49/505

[56] References Cited

U.S. PATENT DOCUMENTS

| | | | |
|---|---|---|---|
| 1,966,666 | 7/1934 | Grimes | 52/213 |
| 3,037,589 | 6/1962 | Cole | 52/212 |
| 3,583,114 | 6/1971 | Belfor | 52/217 |
| 3,943,679 | 3/1976 | Dissinger | 52/475 X |
| 4,407,100 | 10/1983 | Hvelsekopf | 52/212 |

*Primary Examiner*—Carl D. Friedman
*Assistant Examiner*—Robert Canfield
*Attorney, Agent, or Firm*—Pro-Techtor International

[57] ABSTRACT

An aluminum frame window includes an outer frame assembly peripherally attached with a water-proof strip assembly, an inner frame assembly fastened to the outer frame assembly on the inside to hold a top-hinged outswinging windowpane and peripherally attached with a water-proof strip assembly, wherein air vents and air fan are made on the top on the inside between the outer frame assembly and the inner frame assembly on the outer frame assembly for ventilation.

4 Claims, 5 Drawing Sheets

ALUMINUM FRAME WINDOW WITH VENTILATING MEANS

BACKGROUND OF THE INVENTION

The present invention relates to aluminum windows and relates more particularly to an aluminum window which is consisted of an outer frame, an inner frame and a water-proof parting strip assembly and which has means for ventilation.

A window has no longer a simple opening in a wall or roof to let in light or air. It has a great concern with the sense of beauty of a building. In recent years, aluminum frame windows are commonly used in building construction to replace conventional wooden sash windows for the advantage of inexpensive to manufacture and easy to install. An aluminum frame window is generally comprised of a windowpane held in an aluminum frame, which is consisted of four aluminum strips. However, conventional aluminum frame windows are not satisfactory in use. One disadvantage of conventional aluminum frame windows is that they may be squeezed to deform easily. Another disadvantage of conventional aluminum frame windows is that they may be caused to deform by pressure or great temperature changes, in reducing their water-proof and wind force protective capabilities. Still another disadvantage of conventional aluminum frame windows is that they stop ventilation as they are closed. Furthermore, they can not effectively eliminate the problem of water leakage as they are fastened to a respective opening in a wall.

SUMMARY OF THE INVENTION

The present invention eliminates the aforesaid disadvantages. It is an object of the present invention to provide an aluminum frame window which is strong against compression force and suitable for use in curtain walls. It is another object of the present invention to provide an aluminum frame window which provides satisfactory water proof and wind force protective effects. It is still another object of the present invention to provide an aluminum frame window which has means for ventilation as it is closed. According to the preferred embodiment of the present invention, an aluminum frame window is comprised of an outer frame assembly to hold an inner frame assembly on the inside. The outer frame assembly is consisted of a front frame and a back frame peripherally attached with a respective water-proof strip assembly for guiding water away. Air vents are made on the front frame and covered by a wire gauze filter. Air vents are made on the back frame and openably covered by a sliding door. An electric air fan is fastened inside the outer frame assembly between the front frame and the back frame for ventilation. The inner frame assembly has a top-hinged outswinging windowpane to which a detecting terminal of a burglar alarm system is attached.

DETAILED DESCRIPTION OF THE PREFERRED EMBODIMENT

Figure 1:
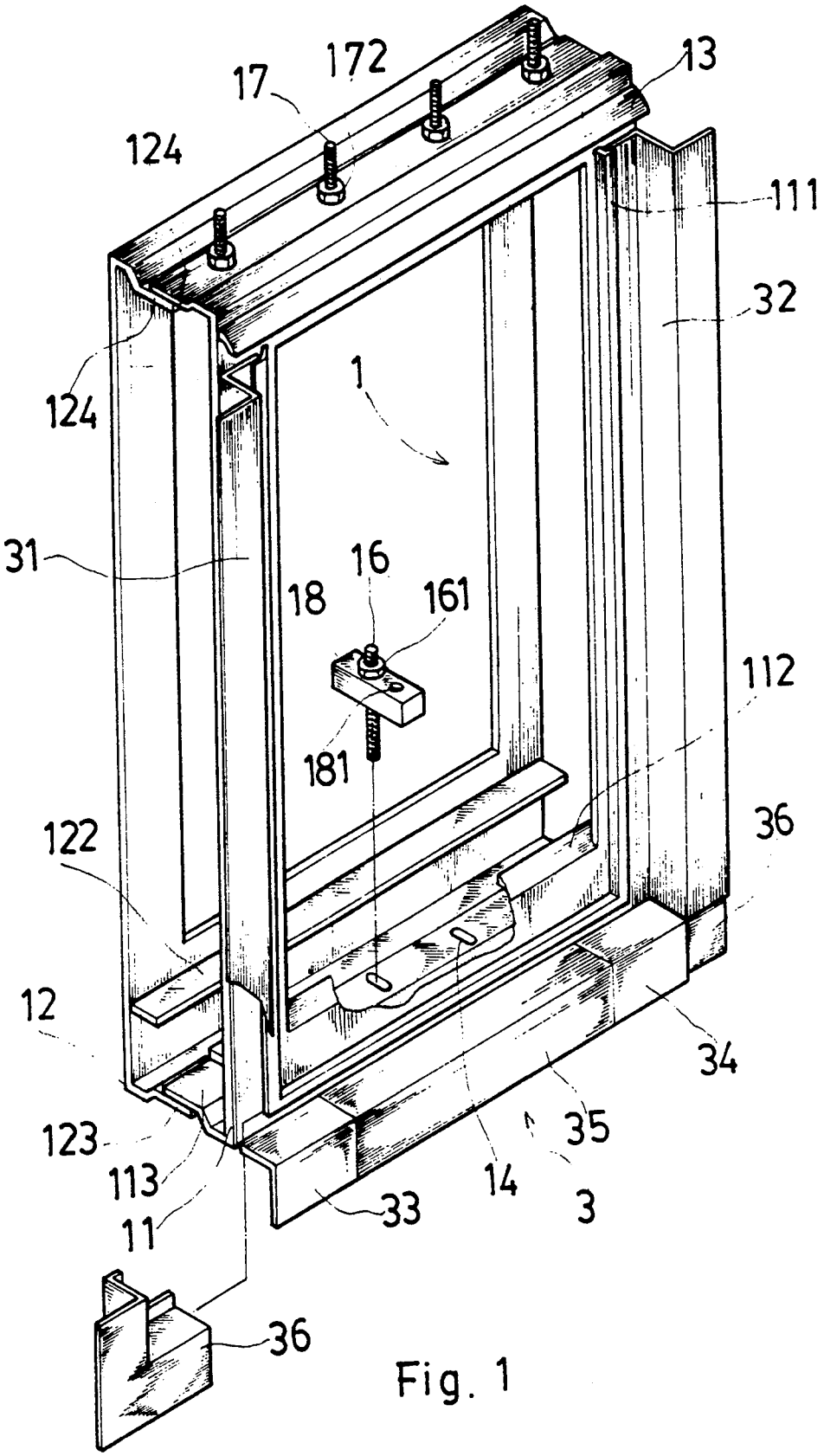
FIG. 1 is an elevational view of the outer frame assembly and the water-proof parting strip assembly of the preferred embodiment of the aluminum frame window of the present invention.
Figure 2:
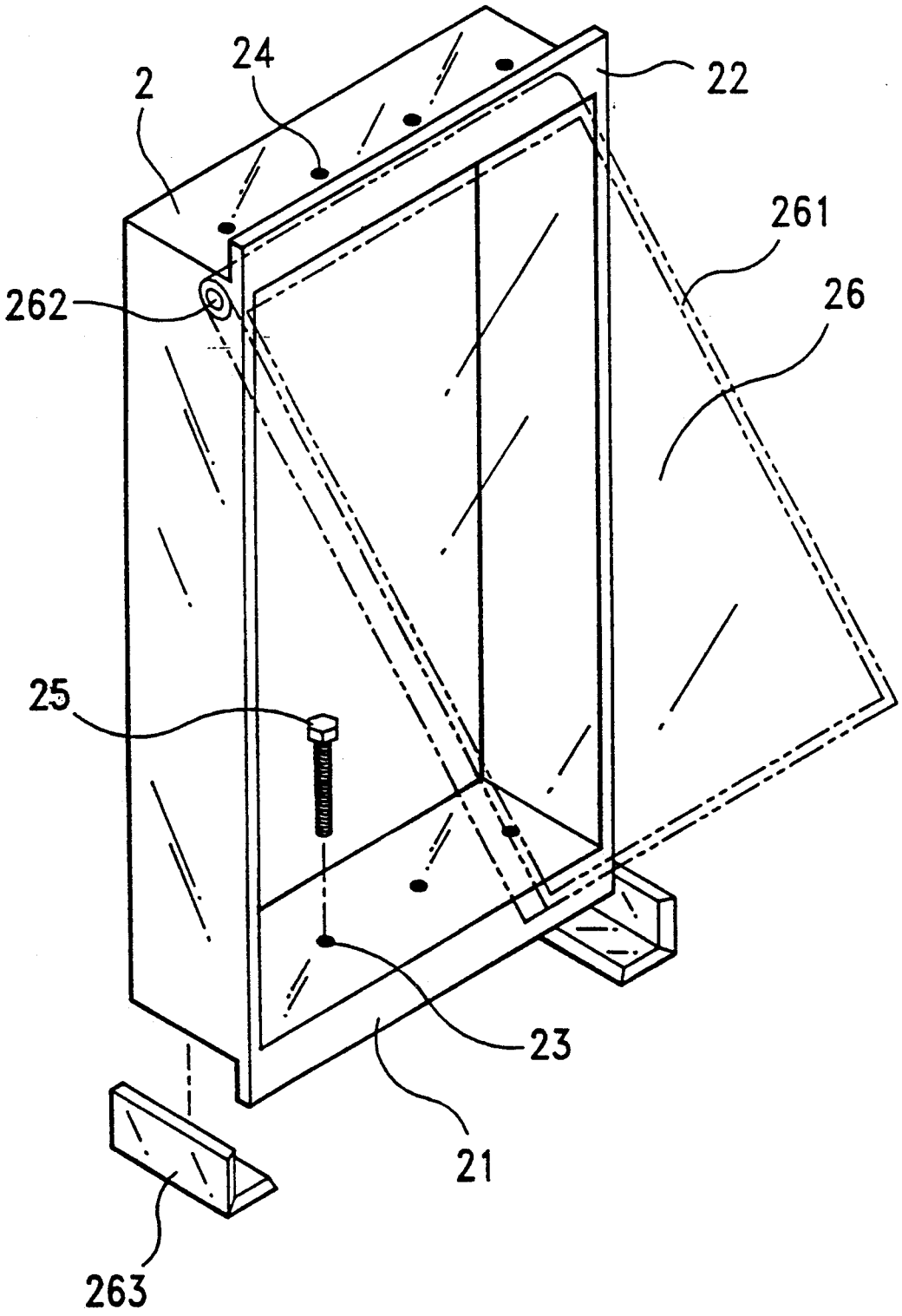
FIG. 2 is an elevational view of the inner frame assembly of the aluminum frame window.
Figure 3:
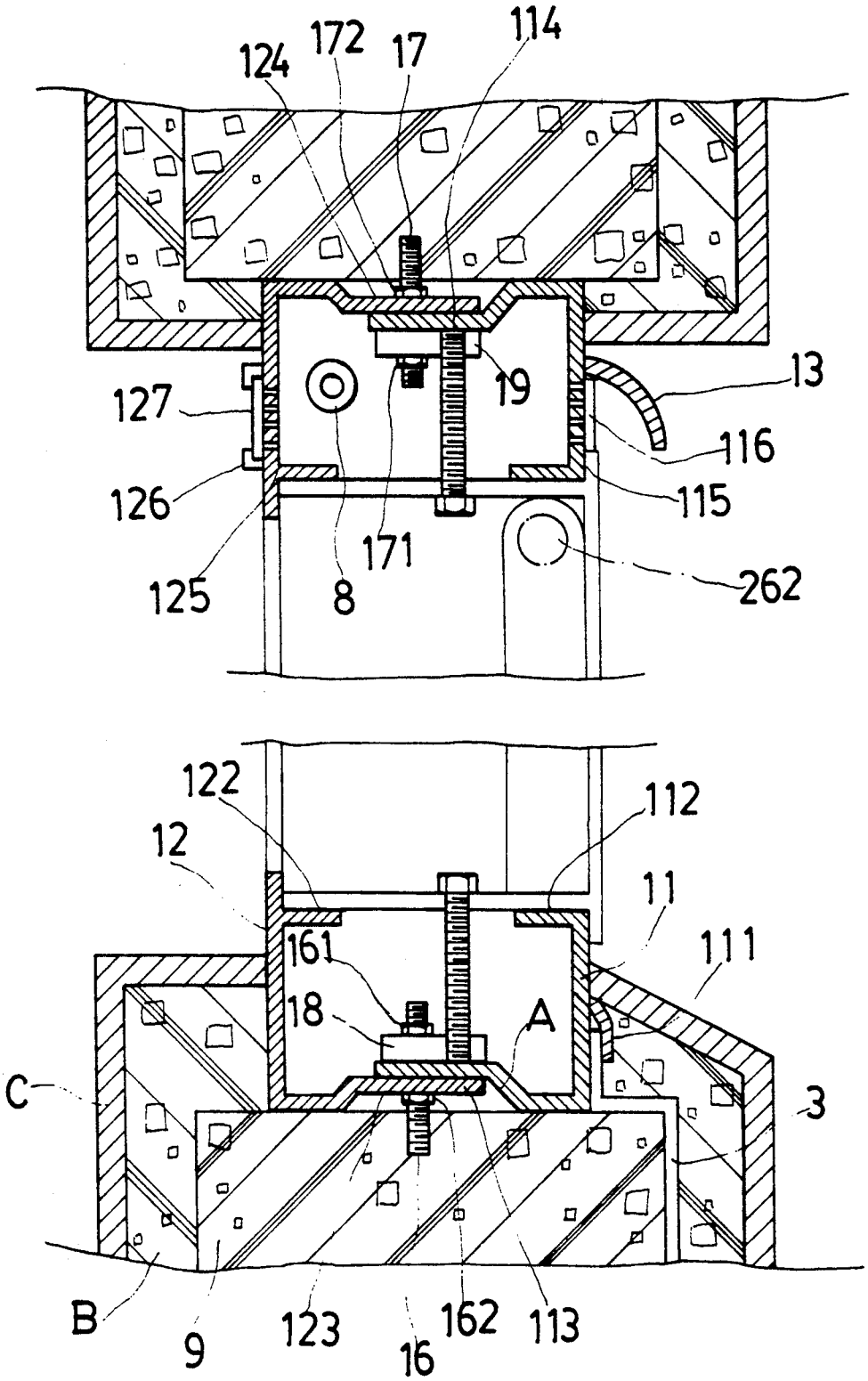
FIG. 3 is a sectional side view of the aluminum frame window.

Referring to FIGS. 1, 2 and 3, an aluminum frame window as constructed in accordance with the present invention is generally comprised of a rectangular outer frame assembly 1, a rectangular inner frame assembly 2, at least one water-proof parting strip assembly 3. The outer frame assembly 1 is consisted of a front frame 11 and a back frame 12. The front frame 11 comprises an elongated water stop 13 having a U-channel invertedly disposed on the top in horizontal direction, and a channel 111 on the inside along the four sides thereof for fastening a water-proof parting strip assembly 3. The back frame 12 can also comprise a channel 112 (not shown) on the inside along the four sides thereof for fastening a water-proof parting strip assembly 3. A water-proof parting strip assembly 3 includes two upright parting strips 31,32 fastened in the channel 111 or 112 on two opposite sides in vertical direction, two bottom parting strips 33,34 fastened in the channel 111 or 112 on the bottom on two opposite corners in horizontal direction, and a horizontal parting strip 35 fastened in the channel 111 or 112 on the bottom and connected between the two lower parting strips 33,34. Two packing plates 36 are respective connected between the upright parting strips 31,32 and the bottom parting strips 33,34 to seal gaps. The front frame 11 and the back frame 12 have each a rail 121 or 122 raised from the respective bottom aligned on the inside at opposite locations. The front frame 11 has a bottom horizontal connecting plate 113 on the bottom overlapped on a bottom horizontal connecting plate 123 on the back frame 12 with adjustment holes 14 respectively aligned, and a top horizontal connecting plate 114 overlapped on a top horizontal connecting plate 124 on the back frame 12 with adjusting holes 15 respectively aligned. Adjusting screw rods 16 are respectively threaded into adjustment holes 14 and locked by lock nuts 161,162 on two opposite ends to secure the bottom horizontal connecting plates 113,123 together. Adjusting screw rods 17 are respectively threaded into adjustment holes 15 and locked by lock nuts 171,172 on two opposite ends to secure the top horizontal connecting plates 114,124 together. A cushion plate 18 each is respectively fastened to the adjusting screw rods 16 above the bottom horizontal connecting plate 113 of the front frame 11. A cushion plate 19 each is respectively fastened to the adjusting screw rods 17 below the top horizontal connecting plate 124 of the back frame 12. The cushion plate 18 or 19 has a screw hole 181 or 191 on a suitable location.

Referring to FIGS. 2 and 3, the rectangular inner frame assembly 2 fits into the front frame 11 and the back frame 12 of the outer frame assembly 1, having a downward bottom stop plate 21 and an upward top horizontal stop plate 22 on the front face thereof, a plurality of screw holes 23 on the bottom respectively aligned with the screw hole 181 on each cushion plate 18 on the bottom of the rectangular outer frame assembly 1, and a plurality of screw holes 24 on the top respectively aligned with the screw hole 191 on each cushion plate 19 on the top of the rectangular outer frame assembly 1. By threading screw bolts 25 through the screw holes 23 or 24 on the rectangular inner frame assembly 2 into the screw hole 181 or 191 on the respective cushion plate 18 or 19, the rectangular inner frame assembly 2 is fastened inside the rectangular outer frame assembly 1. A top-hinged outswinging windowpane 26 framed by a frame 261 is hinged to the rectangular inner frame assembly 2 by a pivot 262. Two angle gaskets 263 are fastened to the rectangular inner frame assembly 2 on the bottom on two opposite ends.

Figure 4:
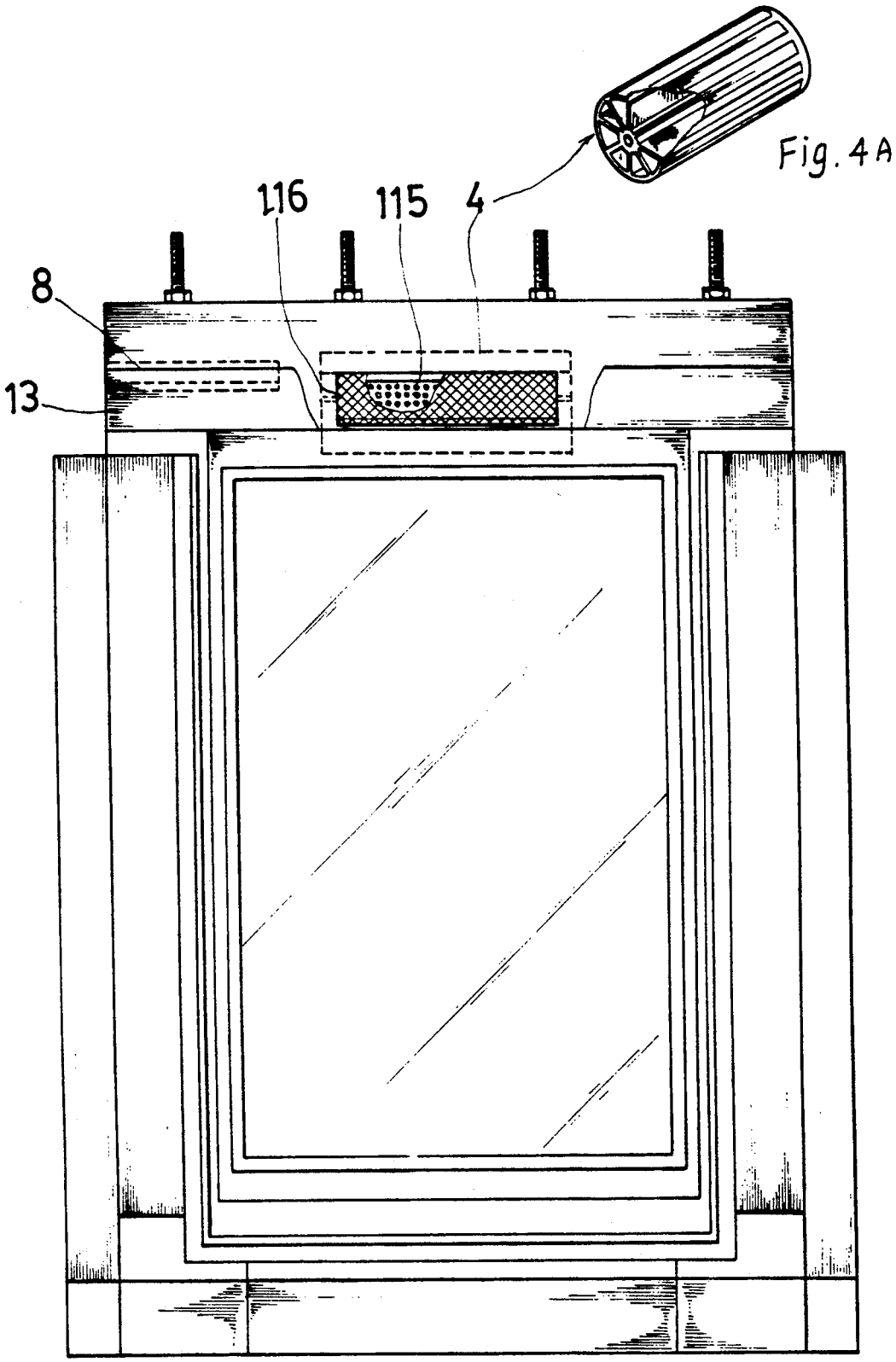
FIG. 4 is a front view of the aluminum frame window.
Figure 5:
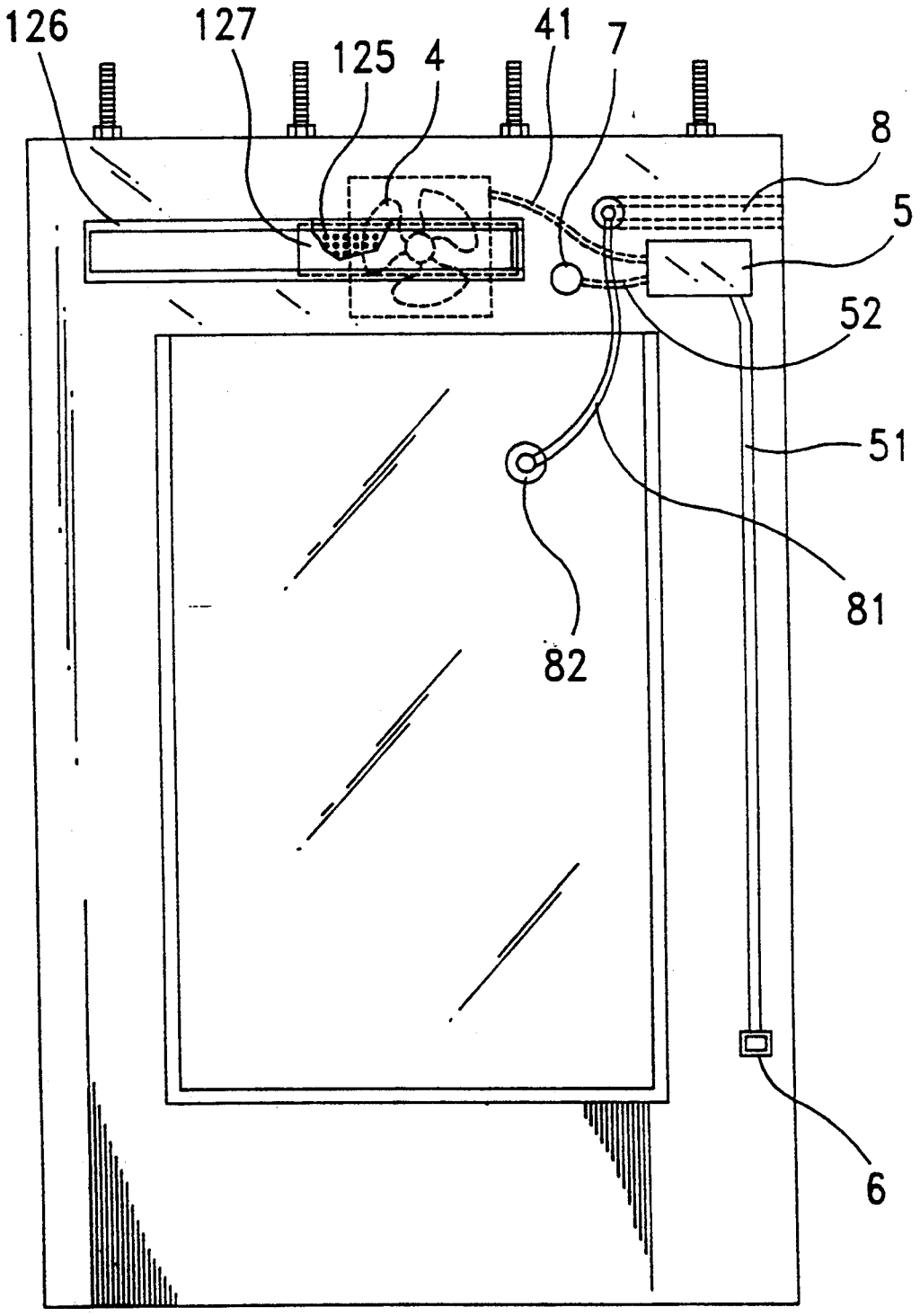
FIG. 5 is a back view of the aluminum frame window.

Referring to FIGS. 3, 4 and 5, the front frame 11 of the rectangular outer frame assembly 1 has air vents 115 on the top covered by a wire gauze filter 116. The back frame 12 of the rectangular outer frame assembly 1 has air vents 125 on the top surrounded by rails 126, and a sliding door 127 fastened to the rails 126 and moved to close or open the air vents 125. An electric air fan 4 is fastened on the inside of the rectangular outer frame assembly 1 between the front frame 11 and the back frame 12 and connected to a storage battery 5 by an electric wire 41. The storage battery 5 is fastened inside the rectangular outer frame assembly 1 and connected to an external power supply switch 6 by an electric wire 52. An inductance lamp 7 is connected to the storage battery 5 by an electric wire 52, which turns on automatically in case of failure of electricity (this is of the known skill and not within the scope of the present invention). An electric wire 81 is inserted through an alarm pipe 8 fastened above the storage battery 5, having one end coupled with a suction disk 82 attached to the windowpane 26 and an opposite end connected to a burglar alarm system (not shown).

Referring to FIg. 3 again, the back frame 12 is placed in a wall 9, the front frame 11 is then mounted on the back frame 12, and then the outer rectangular frame assembly 1 is fastened in place by the adjusting screw rods 16,17 and the lock nuts 161,171,162,172. By means of the adjustment holes 14,15, the front frame 11 and back frame 12 can be moved relative to each other so that the width of the rectangular outer frame assembly 1 is adjusted according to the width of the wall 9. After installation of the rectangular outer frame assembly 1, the water-proof parting strip assemblies 3 are respectively fastened in the channel 111 or alternatively channels 111 and 112 and covered over the wall 9. Then, the rectangular inner frame assembly 2 is inserted into the rectangular outer frame assembly 1 and supported on the rails 121,122 and secured to the cushion plates 18,19 by the screw bolts 25. Because the rectangular inner frame assembly 2 is attached with angle gaskets 263 on the bottom, any rainwater will be guided away from the window and prohibited from penetrating through gaps between the rectangular inner frame assembly 2 and the rectangular outer frame assembly 1 into the wall 9. When installed, a cement paste A is poured into spaces behind the horizontal connecting plates 113,123;114,124 respectively covered over the adjusting screw rods 16,17, and a protective coating B is covered over the parting strip assembly or assemblies 3 and then an ornamental covering C is covered over the protective coating B.

Referring to FIGS. 3 and 5 again, the sliding door 127 may be opened for ventilation through the air vents 115 on the front frame 11 and the air vents 125 on the back frame 12 as the windowpane 26 is closed. The air vents 115 on the front frame 11 are protected by the wire gauze filter 116 and the elongated water stop 13, and therefore outside rainwater and dust are prohibited from entering the air vents 115. By means of the control of the external power supply switch 6, the electric air fan 4 is turned on to produce a current of air for better ventilation. Once the external power supply switch 6 was switched on, the storage battery 5 is continuously charged. The inductance lamp 7 is automatically turned on as external power supply fails. Because the suction disk 82 is attached to the windowpane 26 and connected to a burglar alarm system, opening the windowpane 26 from the outside or damaging it causes the burglar alarm system alarmed.

As indicated, the present invention is to provide an aluminum frame window consisted of an inner frame assembly and an outer frame assembly, which is durable and safe in use and suitable for use in curtain walls.

What is claimed is:

1. An aluminum frame window comprised of a rectangular inner frame assembly fastened inside a rectangular outer frame assembly and a water-proof parting strip assembly fastened to said outer frame assembly, said outer frame assembly comprised of a rectangular front frame connected to a rectangular back frame, said front frame comprising an elongated water stop horizontally disposed on the top, a channel on the inside along a peripheral edge thereof which receives said water-proof parting strip assembly, said water-proof parting strip assembly comprising two upright parting strips fastened in said channel on two opposite sides in vertical direction, two bottom parting strips fastened in said channel on the bottom on two opposite corners in horizontal direction, and a horizontal parting strip fastened in said channel on the bottom and connected between said two lower parting strips, said front frame and said back frame having each a rail raised from a respective bottom and longitudinally aligned to support said inner frame assembly, said front frame having a bottom horizontal connecting plate on the bottom overlapped on a bottom horizontal connecting plate on said back frame, and a top horizontal connecting plate overlapped on a top horizontal connecting plate on said back frame, the bottom horizontal connecting plate and the top horizontal connecting plate of said front frame have each a plurality of elongated adjustment holes respectively aligned with elongated adjustment holes on the bottom horizontal connecting plate and the top horizontal connecting plate of said back frame and secured by respective adjusting screw rods and lock nuts, said adjusting screw rods having each a cushion plate fastened thereto, said cushion plate having a fastening hole through which a fastening element is respectively threaded to fasten said outer frame assembly and said inner frame assembly to a window frame on an opening in a wall.

2. The aluminum frame window as set forth in claim 1 wherein said front frame of said outer frame assembly comprises a plurality of air vents on a top thereof covered by a wire gauze filter.

3. The aluminum frame window as set forth in claim 1 wherein said back frame of said outer frame assembly comprises a plurality of air vents openably covered by a sliding door.

4. The aluminum frame window as set forth in claim 1 wherein said outer frame assembly comprises an air fan fastened on the inside between said front frame and said back frame adjacent to a top edge thereof.

* * * * *